US012194368B2

(12) United States Patent
Hoth

(10) Patent No.: US 12,194,368 B2
(45) Date of Patent: Jan. 14, 2025

(54) SNOWSHOE

(71) Applicant: Ryan C. Hoth, North Logan, UT (US)

(72) Inventor: Ryan C. Hoth, North Logan, UT (US)

( * ) Notice: Subject to any disclaimer, the term of this patent is extended or adjusted under 35 U.S.C. 154(b) by 0 days.

(21) Appl. No.: 13/839,141

(22) Filed: Mar. 15, 2013

(65) Prior Publication Data

US 2014/0259795 A1 Sep. 18, 2014

(51) Int. Cl.
*A63C 13/00* (2006.01)

(52) U.S. Cl.
CPC ..... *A63C 13/001* (2013.01); *A63C 13/005* (2013.01); *A63C 13/003* (2013.01)

(58) Field of Classification Search
CPC ... A63C 13/001; A63C 13/003; A63C 13/005; A63C 13/006; A63C 13/008
USPC ..... 36/122–125
See application file for complete search history.

(56) References Cited

U.S. PATENT DOCUMENTS 4,085,529 A * 4/1978 Merrifield ..... A63C 13/005 36/125
4,620,375 A * 11/1986 Wallace ..... A63C 13/006 36/125
5,740,621 A * 4/1998 Wing et al.
5,829,173 A * 11/1998 Svetlik ..... A63C 13/006 36/122
6,006,453 A * 12/1999 Klebahn et al.
6,012,238 A * 1/2000 McKenzie ..... A43B 5/0411 36/125
6,112,436 A * 9/2000 Quellais
6,256,908 B1 * 7/2001 Warner
8,020,321 B2 * 9/2011 Matthews et al.
2005/0050773 A1 * 3/2005 Kettlehut ..... A63C 13/001 36/122
2012/0151802 A1 * 6/2012 Lin
2015/0201698 A1 * 7/2015 Dussault

* cited by examiner

*Primary Examiner* — Ted Kavanaugh
(74) *Attorney, Agent, or Firm* — Preston P. Frischknecht; Project CIP

(57) ABSTRACT

A snowshoe having a binding for a downhill ski boot on a binding platform which can pitch, i.e., rotate about a transverse axis of the snowshoe. The binding platform is supported on a front strap which is attached to the sides of the framework for the snowshoe, which is of sufficient flexibility to pitch and, preferably, roll, i.e., rotate about the longitudinal axis of the framework. Decking between the binding platform and the framework has a front aperture to permit the binding platform to pitch and roll; is of such length as to permit extension of the framework, which is made possible by having the framework be a tubes separated on its first and second sides and containing an insertable tube in the areas of the separations; and has such flexibility as to enable the decking to fold underneath the binding platform when the tube of the framework is unextended.

11 Claims, 10 Drawing Sheets

SNOWSHOE

BACKGROUND OF THE INVENTION

1. Field of the Invention

This invention relates to a snowshoe, especially a snowshoe for a user wearing a downhill ski boot.

2. Description of the Related Art

A wide variety of snowshoes exists.

The following patents and publications, as explained further below, have features of some significance to the present invention: U.S. Pat. Nos. 5,829,173; 6,256,908; 6,374,518; 6,898,874; 7,080,850; 7,493,709; 7,681,904; 7,707,749; 7,716,855; 7,793,439; 7,930,842; 7,937,855; 8,020,321; and 8,302,331; United States patent publication nos. 2004/0021297, 2004/0250453, 2010/0289251, and 2012/0151802; international publication nos. WO97/28861 and WO2009/067716; Bulgarian patent publication no. BG110843; Chinese patent no. CN201135164; and French patent publication no. 2 971 165.

Projections, also termed "crampons," extending below a snowshoe to aid traction are included in embodiments of the following patents and publications: U.S. Pat. Nos. 6,256,908; 6,374,518; 7,707,749; 7,793,439; 7,930,842; 7,937,855; 8,020,321; and 8,302,331; United States patent publication no. 2004/0250453; international publication nos. WO97/28861 and WO2009/067716; and Bulgarian patent publication no. BG110843.

An adjustable binding to fit different sizes of boots exists in the snowshoes of U.S. Pat. Nos. 5,829,173; 6,256,908; 6,374,518; and 7,716,855; United States patent publication nos. 2004/0250453 (merely a strap) and 2012/0151802 (merely a strap); international publication no. WO97/28861; Chinese patent no. CN201135164; and French patent publication no. 2 971 165.

The length of the snowshoe can be varied in at least some embodiments of U.S. Pat. No. 7,493,709; United States patent publication no. 2012/0151802; and Chinese patent no. CN201135164.

Of the patents and publications only three appear to permit the boot of a user to roll (rotate about the longitudinal axis of the snowshoe), and each of these involves rigid structures, not simply a strap. U.S. Pat. No. 6,898,874 utilizes multiple cables 318 attached to a rigid platform 314 to deform the frame of the snowshoe. U.S. Pat. No. 8,020,321 employs a rigid pivot axle 39 attached to the frame of the snowshoe with multiple bands. And in U.S. Pat. No. 8,302,331 the ends of a rigid axle are pivotally mounted to permit roll.

In U.S. Pat. No. 6,256,908 a binding is held to the frame with a strap (32 in one embodiment and 150 in another embodiment), but there is no indication that the strap permits roll of the binding. U.S. Pat. No. 7,937,855 does not truly appear to be enabling for attachment of a harness 26 (for a boot) to the frame 12, especially so as to enable roll, which the patent does not suggest is possible; and if the harness 26 is attached to the decking, the specified rigidity of the decking would preclude roll. And in United States patent publication no. 2012/0151802 the described pivot of enclosure member 28 due to the elasticity of fixing member 25 appears to mean pitch (rotation about a transverse axis of the snowshoe); there is no indication that the fixing member 25 is adequately long to have the tension of such fixing member 25 at such a level as to permit the enclosure member 28 to roll.

No patent or publication for a traditional snowshoe indicates that the bindings of such snowshoe are suitable for downhill ski boots. U.S. Pat. No. 7,681,904 and related U.S. Pat. No. 7,080,850 makes this assertion, but the subject matter of those patents is a ski which can have its front and rear removed as well as a pivotable lower portion folded outward to create a device for travel on snow which is termed a "snowshoe" but has virtually none of the structure of a traditional snowshoe.

And the decking of U.S. Pat. No. 7,493,709 folds when the length of the snowshoe is shortened but does not go under a platform for a binding.

BRIEF SUMMARY OF THE INVENTION

The Snowshoe of the present invention has a binding platform supported by a front strap attached to the frame of the snowshoe and a rear strap also attached to a frame of the snowshoe. The binding platform has a binding for a traditional downhill ski boot and is attached to the front strap. The front strap is flexible so that it can twist about its longitudinal axis and thereby permit the binding platform to pitch, i.e., rotate about a transverse axis of the snowshoe. The length and, consequently, the tension on the front strap is at a level permitting the attach binding platform to roll, i.e., to rotate about the longitudinal axis of the snowshoe.

Decking is attached to the frame of the snowshoe and contains a forward aperture through which the binding platform can pitch and preferably has a rear aperture through which projections (crampons) can extend to improve the traction of the Snowshoe.

The rear portion of the snowshoe frame is telescopically extendable, and the decking is sufficiently flexible that the decking in the area of extension folds under the binding platform when the frame is not extended.

The Snowshoe, thus, can enable one wishing to downhill ski in an area not served by a ski lift to climb a hill using the snowshoes while carrying downhill skis, preferable releasably attached to a backpack; to place the Snowshoe in an unextended position into the backpack; to use the downhill bindings to place the downhill skis on the user's feet without having to change the user's footwear—generally and inconvenient, uncomfortable task in snow and cold weather; and to ski down the hill. Also, the ability of the Snowshoe to permit the binding platform to roll facilitates the user's moving transversely across the hill, if necessary or desirable.

DETAILED DESCRIPTION OF THE INVENTION

As illustrated in FIGS. 1 through 5 and FIG. 10, the Snowshoe of the present invention accommodate traditional downhill ski boots 1, rather than just a cross-country ski boot.

The basic structure of the Snowshoe comprises a framework 2, preferably a tube 3 which is, as its name indicates, hollow, and even more preferably an aluminum tube 3, similar to that of the Yukon Charlie's Trail Series 8×25 snowshoe.

Figure 3:
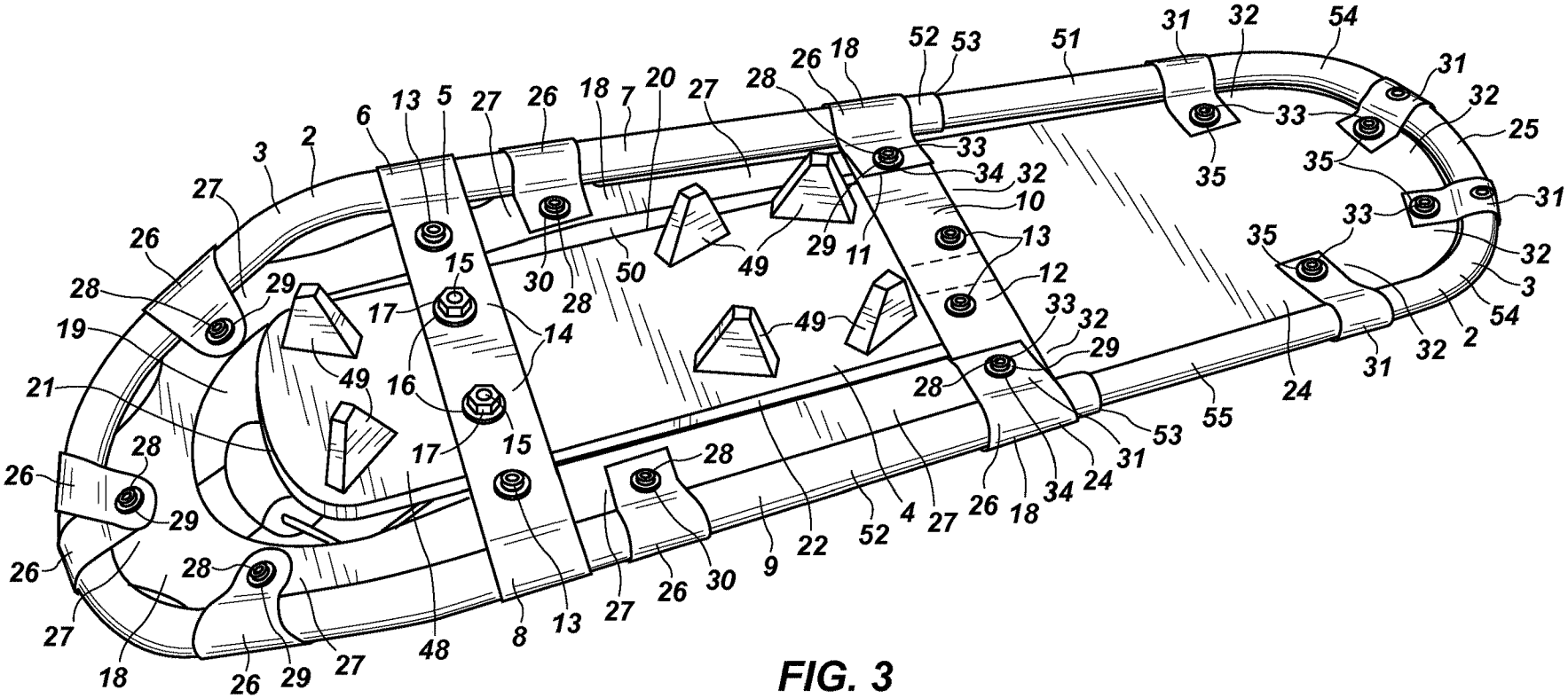
FIG. 3 is a plan view from the bottom of the embodiment shown in FIG. 2.
Figure 5:
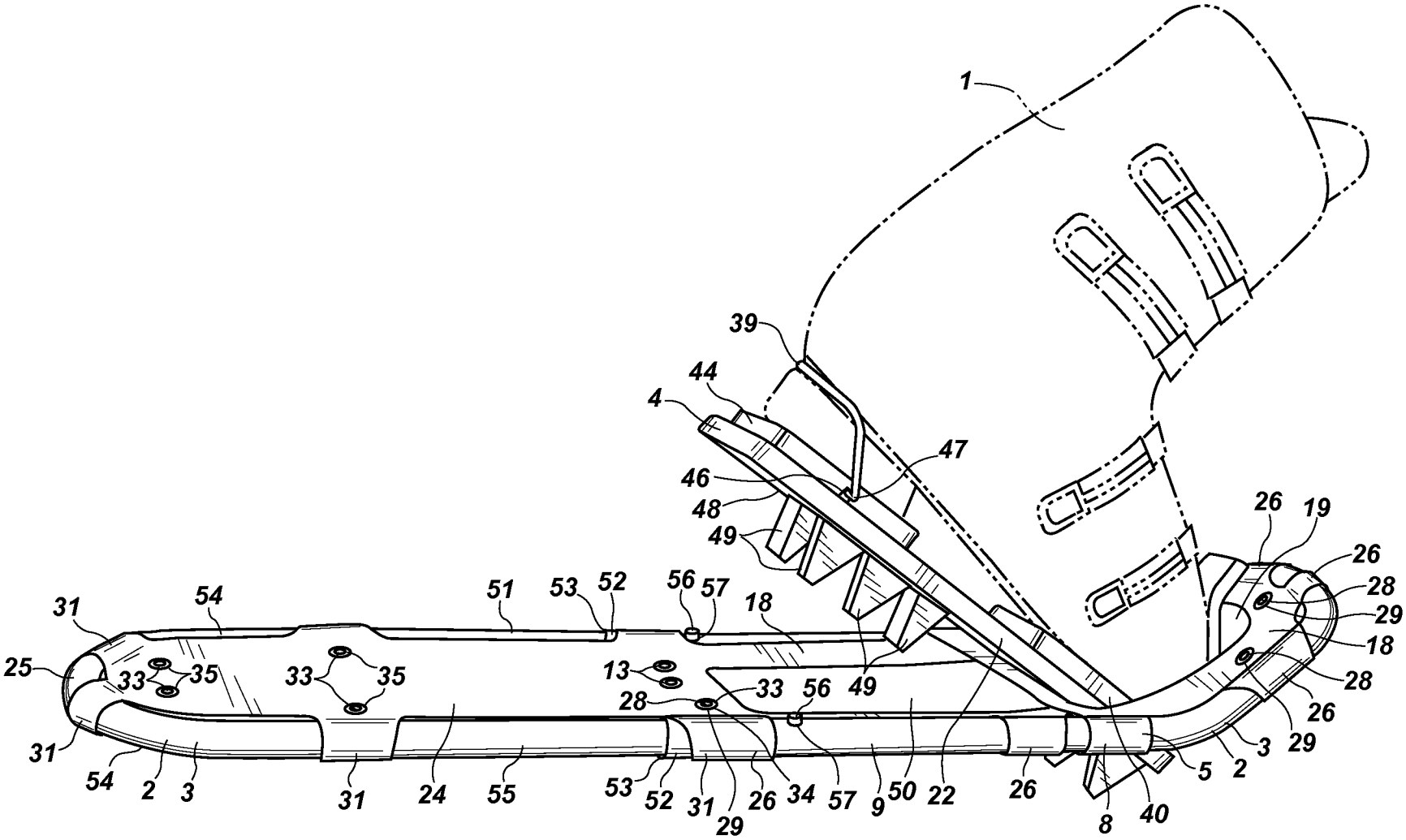
FIG. 5 portrays the embodiment of FIG. 4 with the binding platform rotated in the pitch direction.
Figure 10:
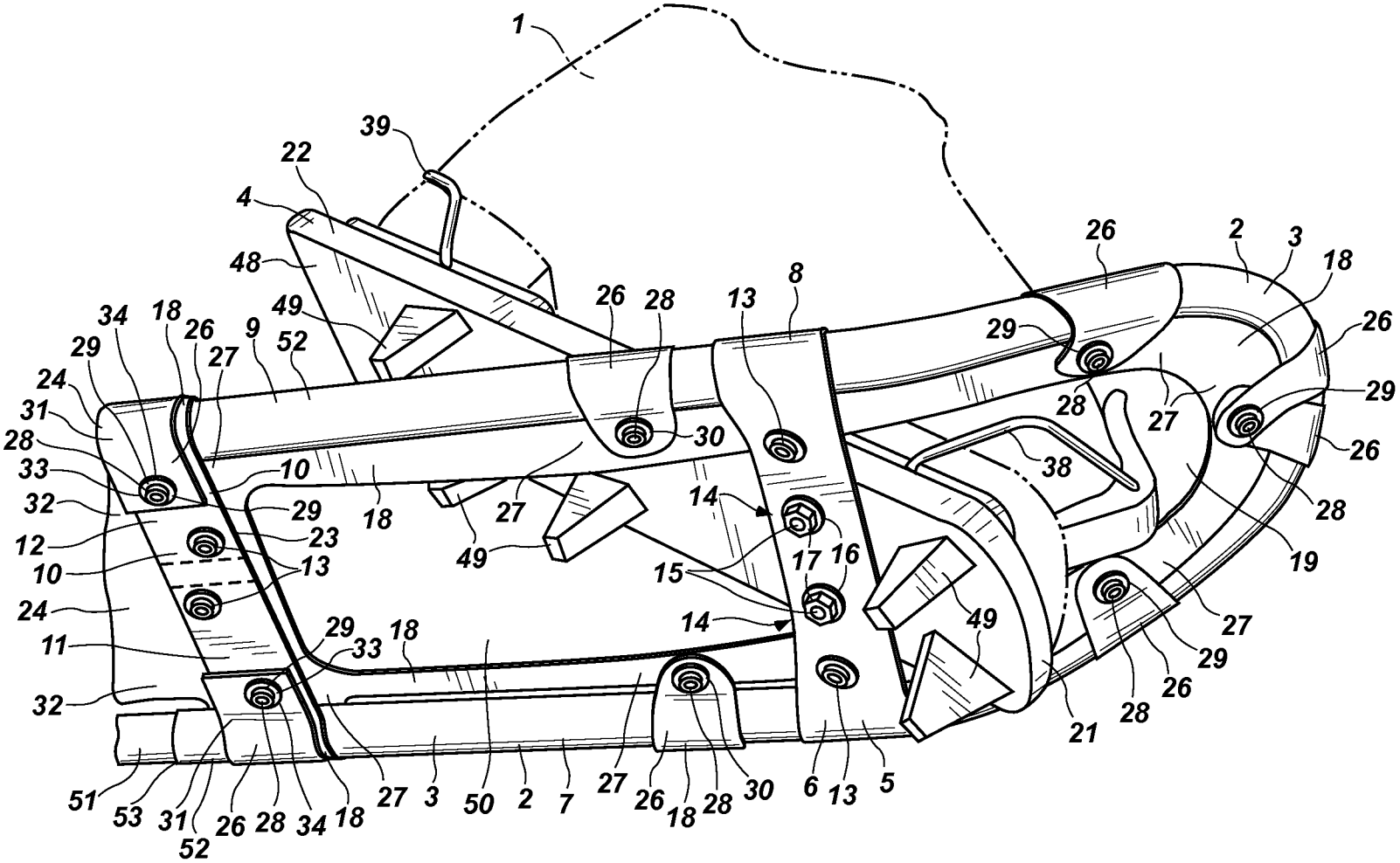
FIG. 10 depicts the embodiment of photograph FIG. 5 from the bottom.

A binding platform 4 is, as seen in FIGS. 3, 5, and 10, supported by (a) a front strap 5 having a first end 6 attached to a first side 7 of the framework 2 and a second end 8 attached to a second side 9 of the framework 2 and (b) a rear strap 10 having a first end 11 attached to a first side 7 of the framework 2 and a second end 12 attached to a second side 9 of the framework 2. The binding platform 4 is attached to the front strap 5 but merely rests on the rear strap 10.

The front strap 5 can be constructed from any material which one of ordinary skill in the art would recognize (a) has sufficient strength to support the binding platform 4 and a user and (b) is preferably sufficiently flexible to permit the binding platform 4 to pitch and to roll. Moreover, the front strap 5 is preferably attached to the framework 2 with a level of tension which also permits the binding platform 4 to roll. The rear strap 10 can be constructed from any material which one of ordinary skill in the art would recognize has sufficient strength to support the binding platform 4 and a user. Attachment of the straps 5, 10 to the framework 2 is preferably accomplished by having a first end 6, 11 wrapped around the framework 2 and connected to itself farther from the first end 6, 11 with a fastener 13, preferably a permanent fastener 13 and even more preferably a rivet 13 and by similarly wrapping and fastening the second end 8, 12.

Attachment of the binding platform 4 to the front strap 5 can be done with any fastener 14 which one of ordinary skill in the art would deem adequate. Preferably, however, such fastener 14 is a releasable fastener; and, even more preferably, such fastener 14 comprises a bolt 15, one or more washers 16, and a nut 17.

To facilitate maintaining the Snowshoe on top of snow, decking 18 is, as depicted in FIGS. 1 through 5 and 10, attached to the framework 2 and preferably also to the straps 5, 10 between the framework 2 and the binding platform 4 while leaving sufficient space, i.e., a front aperture 19 to avoid interfering with the pitching and rolling of the binding platform 4. Preferably the decking 18 extends on and from the rear strap 10 along a first side 20 of the binding platform 4, around the front 21 of the binding platform 4, and along a second side 22 of the binding platform 4 until it is above the rear strap 10 where it extends across the top 23 of the rear strap 10 to the starting point, thereby forming a continuous unit, although the decking 18 may be comprised of a front U-shaped section connected to a rear U-shaped section. Preferably, the front strap 5 and the rear strap 10 are made of rubber, most preferably with a thickness which one of ordinary skill in the art would consider to be one-eighth inch; and the decking 18 is preferably comprised of high-density polyethylene.

Figure 6:
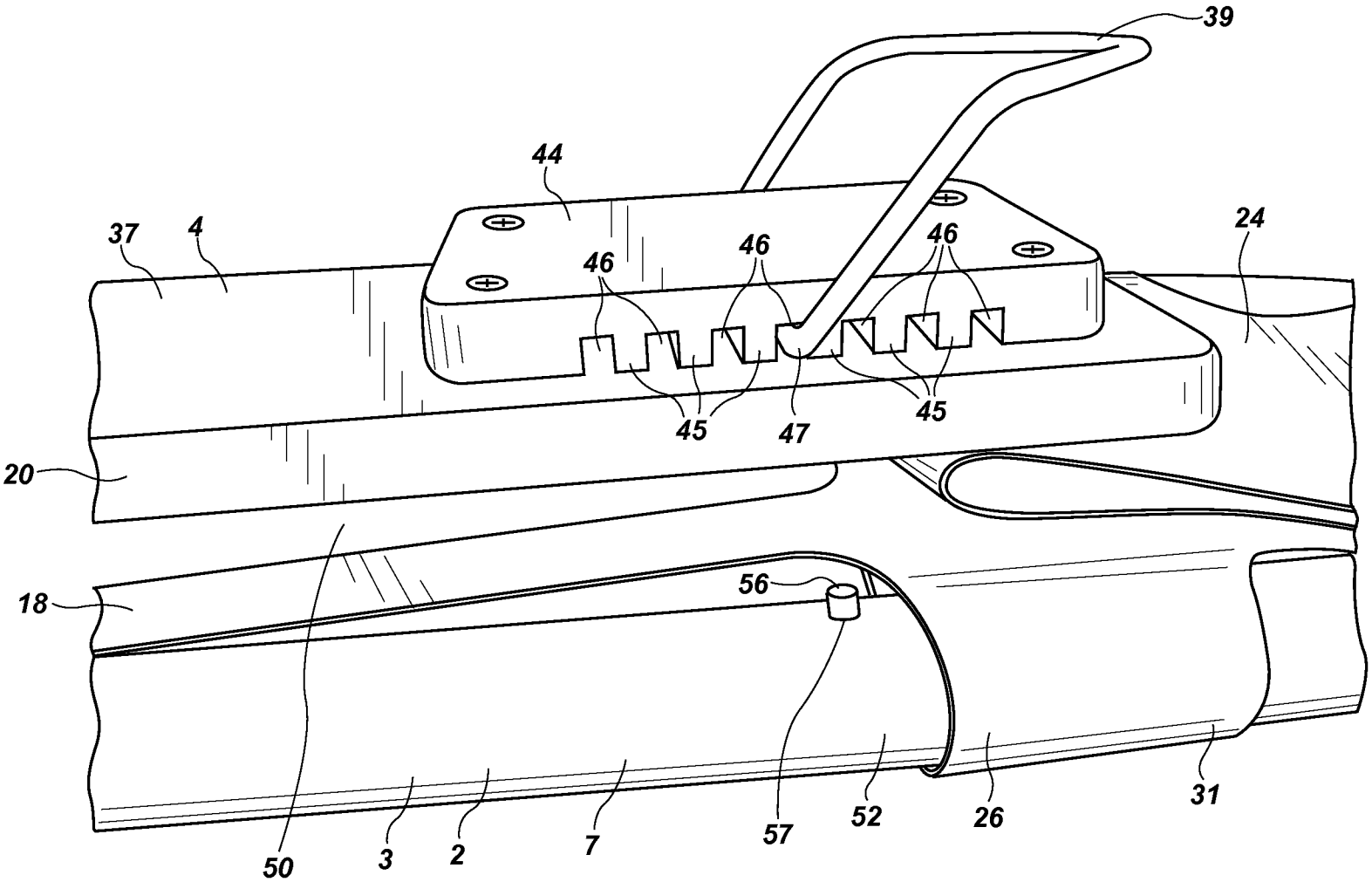
FIG. 6 is an elevational view of channels in the heel plate used to adjust the distance between the toe portion of the binding and the heel portion of the binding and also shows the flexible rear decking folded under the rear of the binding platform.

A rear decking 24, as portrayed in FIGS. 1 through 5, 9 and 10, extends between, and is connected to, the first side 7 of the framework 2, the second side 9 of the framework 2, and the rear portion 25 of the framework 2. The rear decking 24 does not extend forward of the rear strap 10 to which the rear decking is preferably attached, again leaving sufficient space to avoid interfering with the pitching and rolling of the binding platform 4. The rear decking 24 is preferably composed of the same material as the decking 18. The rear decking 24 is, therefore, also preferably comprised of high-density polyethylene. Sufficient material is included for the rear decking 24 to permit full extension of the snowshoe, as explained below, with the material being sufficiently flexible to fold underneath the binding platform 4 when the snowshoe is returned to its unextended length, as depicted in FIG. 6. If desired, the decking 18 and the rear decking 24 can be a unitary structure. Connection of the decking 18 to the framework 2 is preferably achieved by wrapping the edge 26 of the decking 18 around the framework 2 and fastening such edge 26 to a more inward portion 27 of the decking 18, preferably with a rivet 28, and even more preferably with a rivet 28 having at least one outward extension 29 to lower pressure on the decking 18 (Optionally, a washer 30 between the rivet 28 and the decking 18 could accomplish this lowering of pressure on the decking 18). Similarly, connection of the rear decking 24 to the framework 2 is preferably done by wrapping the edge 31 of the rear decking 24 around the framework 2 and fastening such edge 31 to a more inward portion 32 of the rear decking 24, preferably with a rivet 33, and even more preferably with a rivet 33 having at least one outward extension 34 to lower pressure on the rear decking 24 (Optionally, a washer 35 between the rivet 33 and the rear decking 24 could achieve this lowering of pressure on the rear decking 24.)

Figure 1:
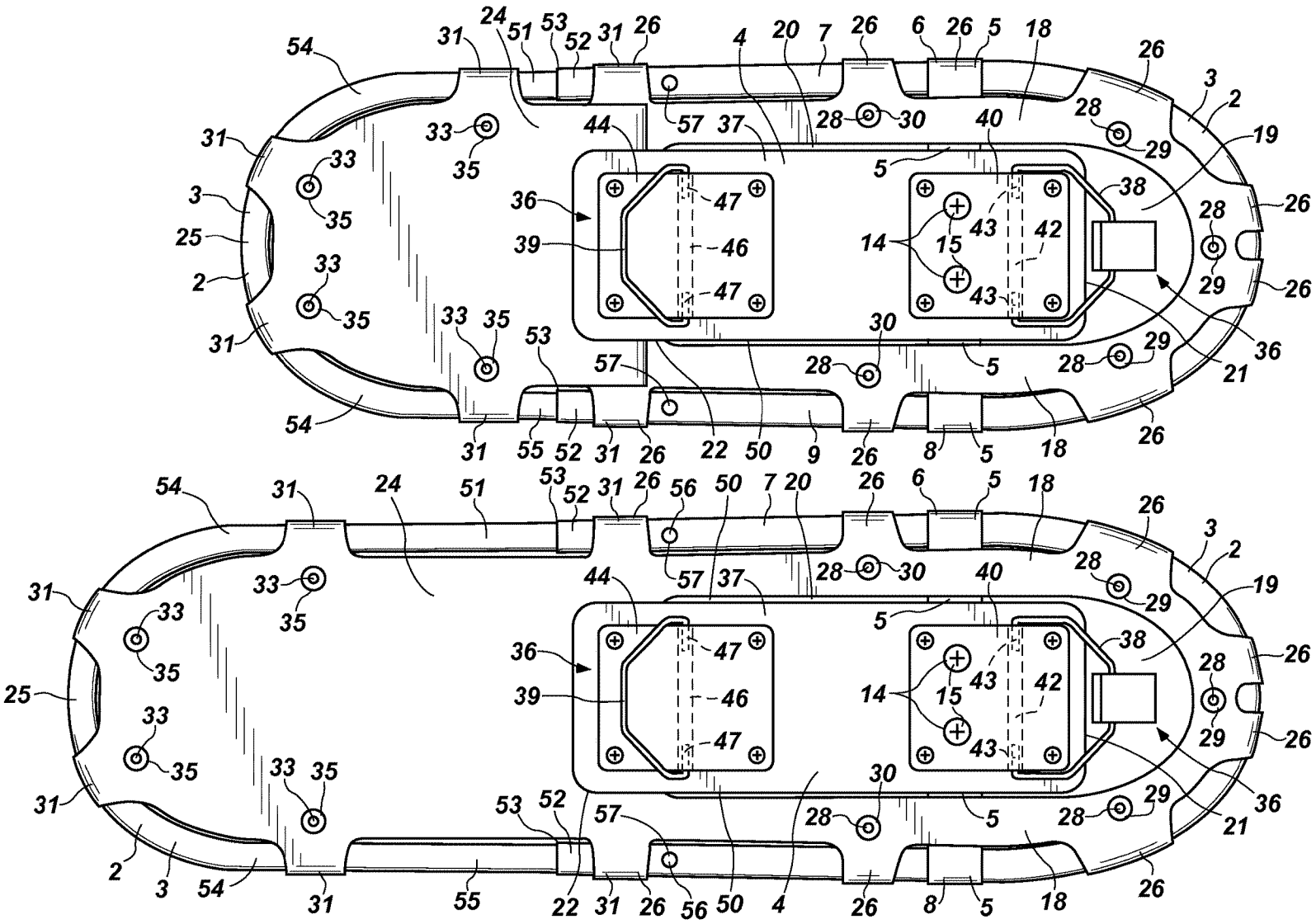
FIG. 1 is a plan view of one extended and one unextended snowshoe.
Figure 2:
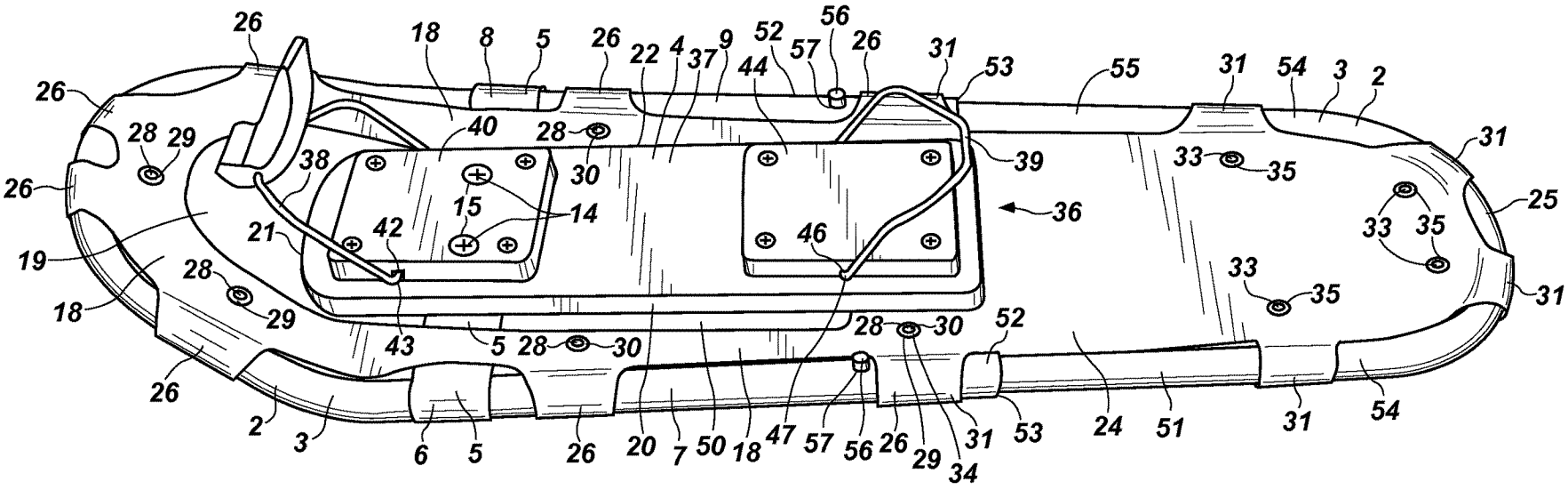
FIG. 2 is an elevational view of an extended snowshoe.
Figure 4:
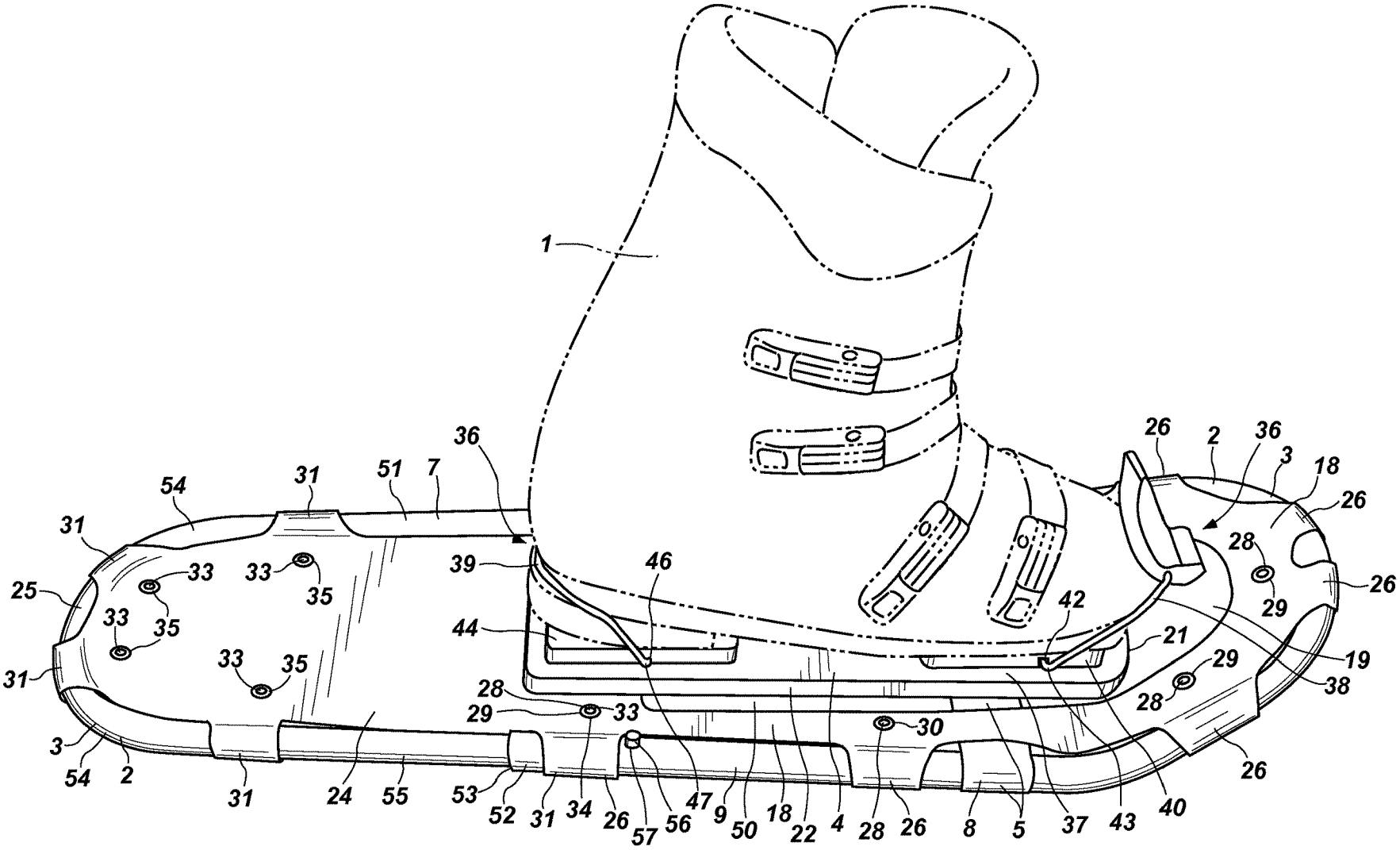
FIG. 4 shows an extended snowshoe holding a traditional downhill ski boot.
Figure 7:
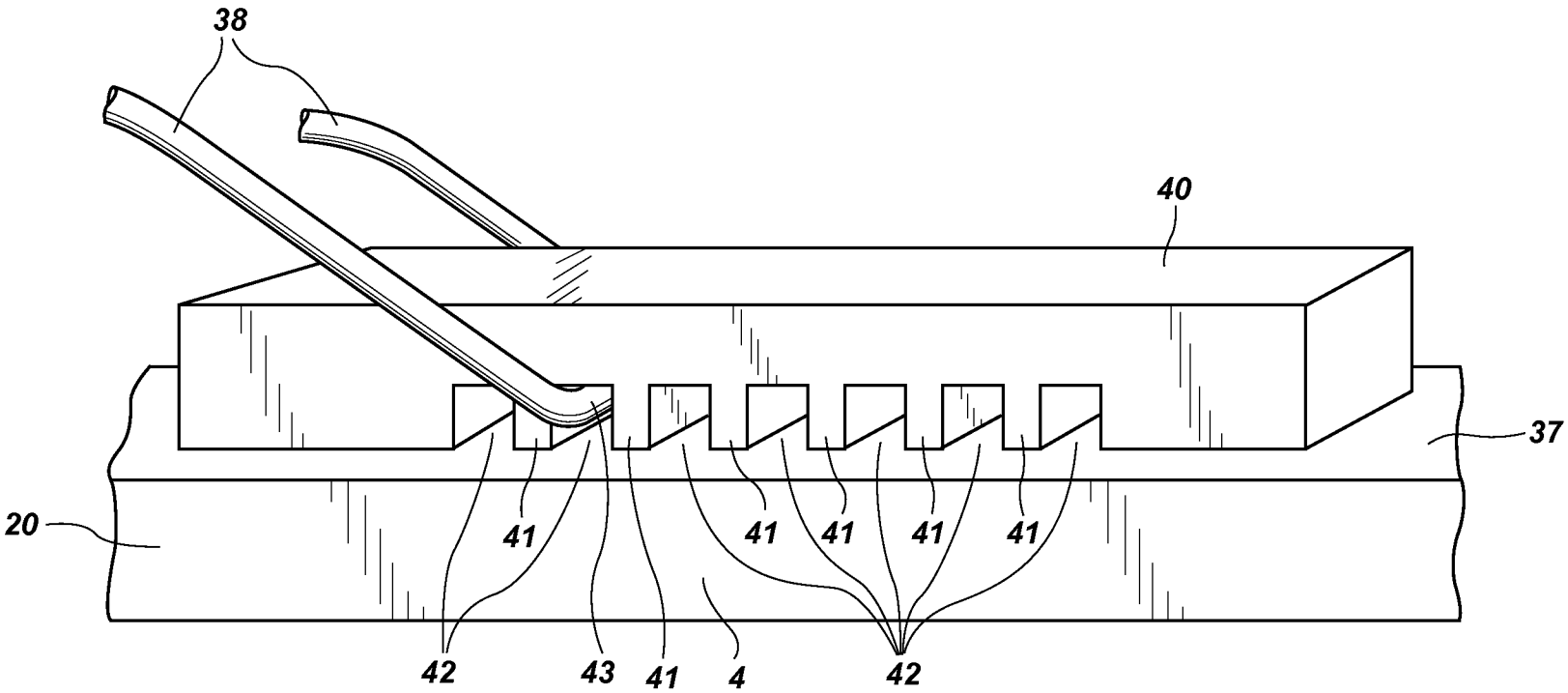
FIG. 7 is an elevational view showing similar channels to those of FIG. 6 but with such channels in the toe plate.
Figure 8:
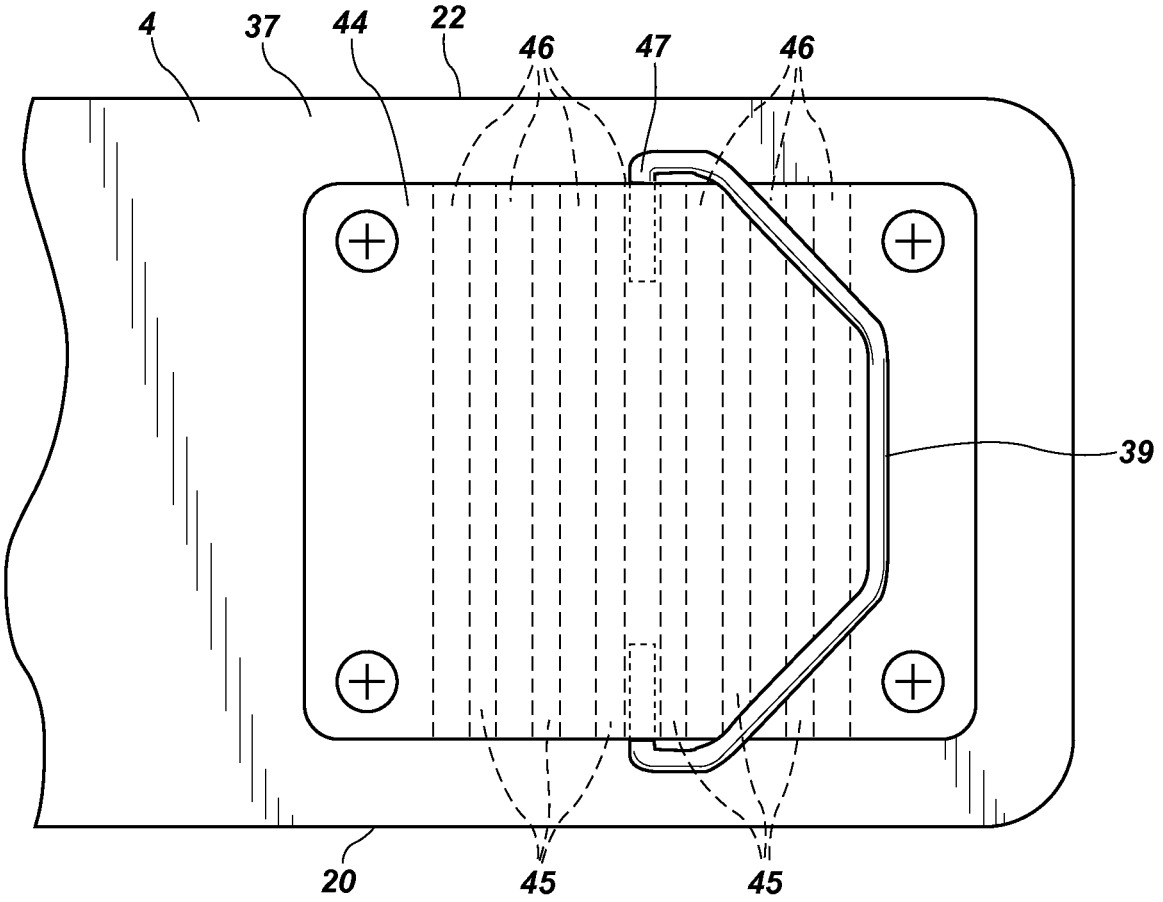
FIG. 8 is a plan view from the top of the heel plate.
Figure 9:
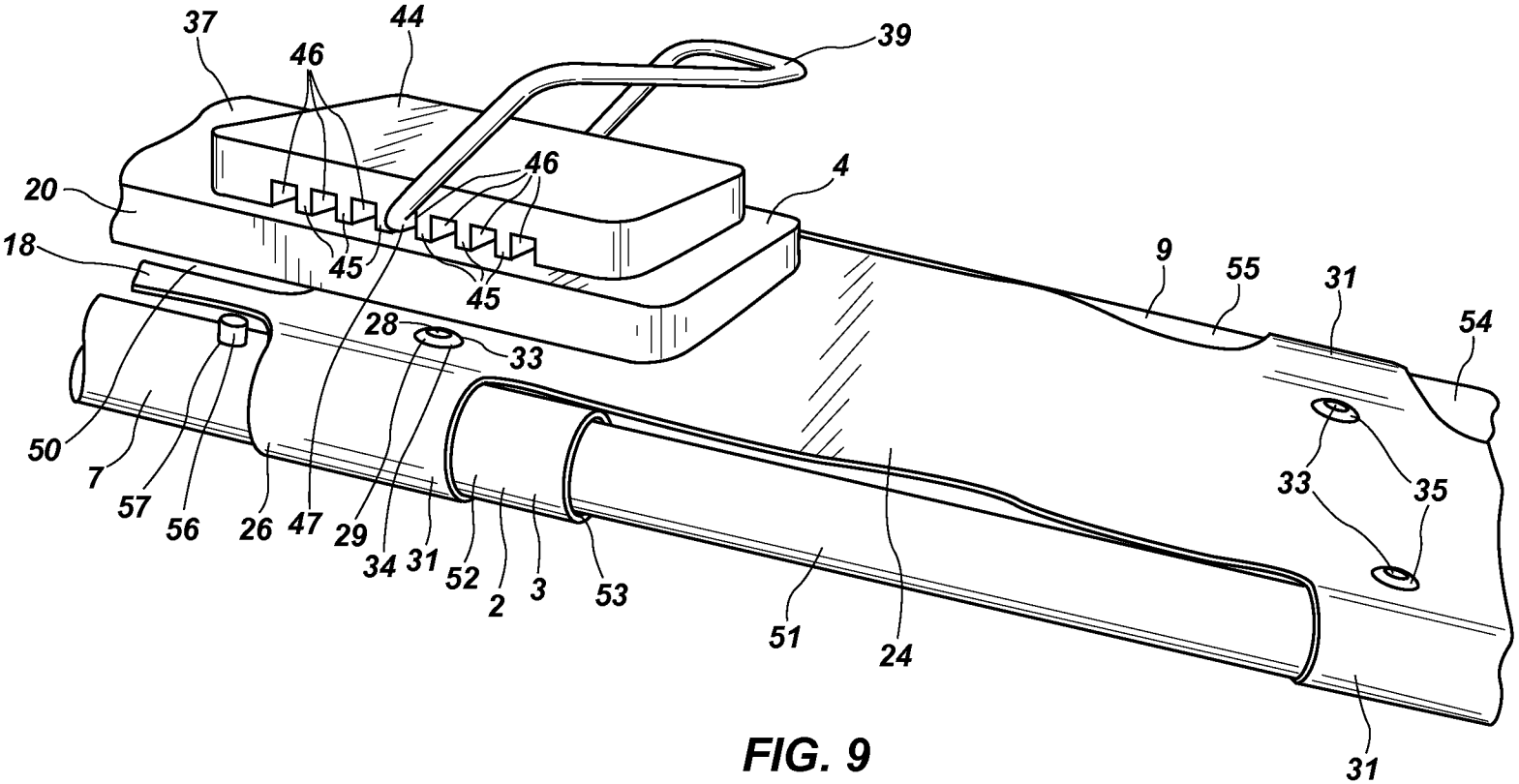
FIG. 9 shows the decking in the extendable portion of the snowshoe extended by the extension of the snowshoe.

Downhill binding 36 is, as illustrated in FIGS. 1, 2 and 4, attached to the top 37 of the binding platform 4. Preferably, the distance between the toe portion 38 of the binding 36 and the heel portion 39 of the binding 36 is adjustable. Preferably, a toe plate 40 has, as seen in FIG. 7, downwardly extending projections 41 which, by releasable connection of the toe plate 40 to the top 37 of the binding platform 4, are releasably held against the top 37 of the binding platform 4 to create a series of transverse channels 42 into which a lower bar 43 of the toe portion 38 of the binding 36 can be selectively inserted. Similarly, preferably a heel plate 44 has, as shown in FIGS. 6, 8, and 9, downwardly extending projections 45 which, by releasable connection of the heel plate 44 to the top 37 of the binding platform 4, are releasably held against the top 37 of the binding platform 4 to create a series of transverse channels 46 into which a lower bar 47 of the heel portion 39 of the binding 36 can be selectively inserted. The distance between the toe portion 38 of the binding 36 and the heel portion 39 of the binding 36 is, thus, determined by the channels 42, 46 into which the lower bar 43 of the toe portion 38 of the binding 36 and the lower bar 47 of the heel portion 39 of the binding 36 are placed. Toe 38 and heel portion 39 of the binding are shown in the illustrated embodiment as generally rigid bales and/or bars that comprise the primary and/or only means for attaching a downhill ski boot to the snowshoe. Also, as shown in the illustrated embodiment, the downhill ski binding 36 is not configured to releasably attach to the snowshoe during the normal operation thereof.

Any downhill binding can, however, be attached to the top 37 of the binding platform 4. But because of their considerable length, new adjustable bindings on a platform, such as the TYROLIA PowerRail, are the least preferred for this purpose.

The bottom 48 of the binding platform 4 preferably has along the first side 20 and the second side 22 of the binding platform projections (crampons) 49 to aid traction in snow. In such an embodiment the decking 18 also contains, as seen most clearly in FIGS. 2, 3, 5, and 10, a rear aperture 50 to accommodate such projections 49.

With the snowshoe constructed as described above, an entire traditional downhill ski boot 1 is, as shown in FIGS. 4, 5, and 10, attached to the binding platform 4 through use of a toe portion 38 of the binding 36 and a heel portion 39 of the binding, but because of the ability of the binding platform 4 to pitch and roll, a user experiences the same effect as with a cross-country ski boot wherein either (a) only the front of the boot, and not the heel, is attached to a binding that can pitch or (b) both the front of the boot and the rear of the boot are attached to a pitchable binding (as in U.S. Pat. No. 7,716,855 and Chinese patent publication no. CN201135164Y) but not with structure which substantially immobilizes the boot in the binding as does a binding 36 for a traditional downhill ski boot 1. A user of the present invention, consequently, can, as explained above, utilize the same pair of boots 1 for downhill skiing and also for snowshoeing. This facilitates wearing the snowshoes to climb a hill while carrying downhill skis with a backpack and then wearing the downhill skis to ski down the hill while carrying the snowshoes with the backpack.

In order to have the length of the snowshoe of the present invention adjustable, the tube 3 is separated on both the first side 7 and the second side 9 of the framework 2, a first insertable tube 51 having a smaller diameter than the tube 3 is inserted, on the first side 7 of the framework 2, within the section 52 of tube 3 forming the portion of the framework 2 forward of the separation 53 and also within the section 54 of the tube 3 forming the portion of the framework 2 rearward from the separation 53; and a second insertable tube 55 having a smaller diameter than the tube 3 is inserted, on the second side 7 of the framework 2, within the section 52 of tube 3 forming the portion of the framework 2 forward of the separation 53 and also within the section 54 of the tube 3 forming the portion of the framework 2 rearward from the separation 53. The point of separation 53 is selected to be rearward from the rear strap 10.

The first insertable tube 51 is permanently attached, on the first side 7 of the framework 2, inside either the section 52 of the tube 3 forming the forward portion of the framework 2 or inside the section 54 of the tube 3 forming the rearward portion of the framework 2, but preferably inside the section 54 of the tube 3 forming the rearward portion of the framework 2, and slidably mounted within the other section 52 of the tube 3. A means, furthermore, exists for holding the first insertable tube 51 at one or more discrete distances inside the section 52 or 54 of the tube 3 wherein the first insertable tube 51 is slidably mounted. Such means is preferably a spring-loaded button 55 inserted into the first insertable tube 51 and one or more apertures 57 in the section 52 or 54 of the tube 3 within which the first insertable tube 3 is slidably mounted on the first side 7 of the framework to accommodate, as illustrated in FIGS. 1 and 4, the spring-loaded button 56 in the extended position of such spring-loaded button 56.

Similarly, the second insertable tube 55 is permanently attached, on the second side 9 of the framework 2, inside either the section 52 of the tube 3 forming the forward portion of the framework 2 or inside the section 54 of the tube 3 forming the rearward portion of the framework 2, but preferably inside the section 54 of the tube 3 forming the rearward portion of the framework 2, and slidably mounted within the other section 52 of the tube 3. A separate means for holding the second insertable tube 55 at one of several discrete distances inside the section 52 or 54 of the tube 3 wherein the second insertable tube 55 is slidably mounted is unnecessary since this function will be accomplished by the means for holding the first insertable tube 51 at one or more discrete distance inside the section 52 or 54 of the tube 3 wherein the first insertable tube 51 is slidably mounted. Of course, if desired, such means could be associated with the second insertable tube 55 rather than the first insertable tube 51.

A non-exclusive list of material from which the first insertable tube 51 and the second tube 55 can be constructed is copper and aluminum, with aluminum being preferred.

Extending the length of the Snowshoe permits the Snowshoe to accommodate a larger, heavier user.

As used herein the term "preferable" or "preferably" means that a specified element or technique is more acceptable than another but not that such specified element or technique is a necessity.

I claim:

1. A snowshoe which comprises:

a framework having a first side, a second side;

a front strap having a first end attached to the first side of said framework and a second end attached to a second side of said framework, the front strap configured to roll generally within a longitudinal axis that is perpendicular to a longitudinal axis of the framework;

a binding platform attached to and supported by said front strap, said binding platform having a front, a first side, a second side, and a top;

a downhill ski boot binding attached to the top of said binding platform, the downhill ski boot binding comprised of a generally rigid toe fastening portion and a generally rigid heel fastening portion, wherein each of the generally rigid toe and heel fastening portions is configured to be primary means for attaching a downhill ski boot with an instep to the snowshoe, the downhill ski binding located forward and rearward of the instep when the downhill ski boot is attached to the snowshoe;

a rear strap having a first end attached to the first side of said framework and a second end attached to a second side of said framework to support said binding platform; and a decking attached to said framework, being located between said framework and said binding platform, and having a front aperture to avoid interfering with the pitching of said binding platform.

2. The snowshoe of claim 1, the binding platform further being generally rigid and having a length that is at least one-third as long as a length of the snowshoe along its longitudinal axis.

3. A snowshoe, which comprises:

a framework having a first side, a second side;

a front strap having a first end attached to the first side of said framework and a second end attached to a second side of said framework, the front strap configured to roll generally within a longitudinal axis that is perpendicular to a longitudinal axis of the framework;

a binding platform attached to and supported by said front strap, said binding platform having a front, a first side, a second side, and a top;

a downhill ski boot binding attached to the top of said binding platform, the downhill ski boot binding comprised of a generally rigid toe fastening portion with a bar and a generally rigid heel fastening portion with a bar, wherein each of the generally rigid toe and heel fastening portions is configured to directly attach a downhill ski boot to the snowshoe and be primary means for attaching a downhill ski boot to the snowshoe;

a rear strap having a first end attached to the first side of said framework and a second end attached to a second side of said framework to support said binding platform;

a decking attached to said framework, being located between said framework and said binding platform, having a front aperture to avoid interfering with the pitching of said binding platform, and extending across the top of said rear strap; and a rear decking extending between and connect to the first side, the second side and the rear portion of said framework, said rear decking not extending forward of said rear strap.

4. The snowshoe of claim 3, the binding platform further being generally rigid and having a length that is at least one-third as long as a length of the snowshoe along its longitudinal axis.

5. The snowshoe of claim 3, the binding platform having a rear portion that is configured to rest above the rear strap.

6. A snowshoe, which comprises:

a frame;

a flexible decking generally within and connected to the frame; and a downhill ski binding attached to the frame, the downhill ski binding having a generally rigid toe portion and a generally rigid heel portion, each of which is configured to be only means for attaching a downhill ski boot with an instep to the showshoe, the downhill ski binding located forward and rearward of the instep when the downhill ski boot is attached to the snowshoe;

a front strap having a first end attached to the first side of said frame and second end attached to a second side of said frame;

a rear strap having a first end attached to the first side of said frame and a second end attached to a second side of said frame; and a generally rigid binding platform having a rear portion that is configured to rest on the rear strap.

7. The snowshoe of claim 6, the downhill ski boot binding configured to adjust to accommodate a plurality of downhill ski boot sizes.

8. The snowshoe of claim 6, the downhill ski boot binding attached to the generally rigid binding platform that has a length that is at least one-third as long as a length of the snowshoe along its longitudinal axis.

9. The snowshoe of claim 6, the snowshoe having a frame length that is telescopically adjustable.

10. The snowshoe of claim 9, wherein a portion of the decking attached to the frame is configured to roundedly fold above the frame during telescopic adjustment to shorten the frame and roundedly unfold from above the frame during telescopic adjustment to lengthen the frame.

11. The snowshoe of claim 6, wherein the downhill ski binding is not configured to releasably attach to the snowshoe during normal operation.

* * * * *